US005776853A

United States Patent [19]

Takao

[11] Patent Number: 5,776,853

[45] Date of Patent: Jul. 7, 1998

[54] THERMAL TRANSFER IMAGE-RECEIVING SHEET

[75] Inventor: Shino Takao, Tokyo, Japan

[73] Assignee: Dai Nippon Printing Co., Ltd., Japan

[21] Appl. No.: 574,896

[22] Filed: Dec. 19, 1995

[30] Foreign Application Priority Data

Dec. 20, 1994 [JP] Japan ..... 6-334656

[51] Int. Cl.[6] ..... B41M 5/035; B41M 5/38

[52] U.S. Cl. ..... 503/227; 428/195; 428/328; 428/423.1; 428/447; 428/690; 428/913; 428/914

[58] Field of Search ..... 8/471; 428/195, 428/690, 913, 914, 328, 423.1, 447; 503/227

[56] References Cited

U.S. PATENT DOCUMENTS 4,992,414 2/1991 Kishida et al. ..... 503/227

FOREIGN PATENT DOCUMENTS

| | | | |
|---|---|---|---|
| 0328144 | 8/1989 | European Pat. Off. | 503/227 |
| 0 505 993 A1 | 9/1992 | European Pat. Off. | 503/227 |
| 0 509 149 A1 | 10/1992 | European Pat. Off. | 503/227 |
| 0 678 397 A1 | 10/1995 | European Pat. Off. | 503/227 |
| 0 699 542 A1 | 3/1996 | European Pat. Off. | 503/227 |
| 63-108338 | 5/1988 | Japan | 503/227 |

*Primary Examiner*—Bruce H. Hess

[57] ABSTRACT

There is provided a thermal transfer image-receiving sheet including a substrate sheet and an intermediate layer and a receptive layer provided in that order on at least one side of the substrate sheet, the intermediate layer being formed of at least one resin having an active hydrogen, the receptive layer including at least one thermoplastic resin and a curing agent reactive with the active hydrogen.

9 Claims, No Drawings

THERMAL TRANSFER IMAGE-RECEIVING SHEET

BACKGROUND OF THE INVENTION

1. Field of the Invention

This invention relates to a thermal transfer image-receiving sheet for use in a thermal dye transfer system and more particularly to a thermal transfer image-receiving sheet comprising a substrate sheet and an intermediate layer and a receptive layer provided in that order on at least one side of the substrate sheet wherein the intermediate layer and the receptive layer can be easily formed as desired and, in thermal transfer using a sublimable dye, a good image can be formed.

2. Background Art

Various thermal transfer recording systems are known in the art, and one of them is a thermal dye transfer system in which sublimable dyes as a colorant are thermally transferred from a thermal transfer sheet comprising a substrate sheet, such as a polyester film, bearing the colorants onto a thermal transfer image-receiving sheet comprising a substrate sheet, such as paper or a plastic film, bearing a dye-receptive layer, thereby forming various full-color images on the image-receiving sheet.

In this case, a thermal head mounted on a printer is used as heating means, and dots of three or four colors are transferred onto the receptive layer of a thermal transfer image-receiving sheet by controlled heating for a very short period of time, thereby reproducing a full-color image of an original utilizing the dots of a plurality of colors.

The image thus formed, since dyes are used as the colorant, has excellent sharpness, transparency, halftone reproduction, and gradation, and the quality thereof is comparable to that of images formed by the conventional offset printing or gravure printing and that of full-color photographic images.

The construction of a thermal transfer sheet as well as the construction of an image-receiving sheet for forming an image is important for effectively carrying out the thermal transfer process. Conventional image-receiving sheets are disclosed in, for example, Japanese Patent Laid-Open Nos. 169370/1982, 207250/1982, and 25793/1985 wherein a dye-receptive layer is formed using a coating liquid of a vinyl resin, such as a polyester resin, a polyvinyl chloride resin, or a polyvinyl butyral resin, a polycarbonate resin, an acrylic resin, a cellulosic resin, a polyolefin resin, or a polystyrene resin, dissolved or dispersed in an organic solvent.

The above thermal transfer image-receiving sheet, however, has drawbacks such as unsatisfactory adhesion between the substrate sheet and the receptive layer and unsatisfactory adhesion between the receptive layer and an intermediate layer provided, on the substrate sheet, for imparting a cushioning property or improving the whiteness. In addition, a solvent cannot be easily removed by drying after coating of a coating liquid for a receptive layer. Furthermore, the provision of the intermediate layer on the substrate sheet for imparting the cushioning property or improving the whiteness requires prolonged drying time and, at the same time, is likely to result in the occurrence of a residual solvent.

In order to solve the above problems, a method is considered effective wherein an intermediate layer is first provided by coating an aqueous coating liquid using a water-soluble resin as a binder and a receptive layer for receiving a dye thereon is then provided in a thickness as small as possible by coating a coating liquid based on an organic solvent. In this method, the amount of the residual solvent can be certainly reduced. However, the adhesion between the intermediate layer and the receptive layer is likely to become unsatisfactory. In addition, in the formation of an image by means of a thermal head or the like, the receptive layer should function to receive a dye from an ink layer in a thermal transfer sheet and, at the same time, should not be fused to the ink layer, and should have suitable releasability so that it can be smoothly separated from the thermal transfer sheet.

For this reason, when the adhesion between the intermediate layer and the receptive layer is unsatisfactory and when the receptive layer has unsatisfactory releasability, the ink layer and the receptive layer are fused to each other in the course of forming an image, resulting in occurrence of a sound or abnormal transfer, i.e., separation of the receptive layer from the intermediate layer, at the time of separating the image-receiving sheet from the thermal transfer sheet.

SUMMARY OF THE INVENTION

Accordingly, an object of the present invention is to solve the above problems of the prior art and to provide a thermal transfer image-receiving sheet having features including that, in the production of thereof, coatings can be easily dried enabling the problem of the residual solvent to be solved, the adhesion between the intermediate layer and the receptive layer is high, and it, when used in a thermal transfer process using a sublimable dye, can be easily separated from the thermal transfer sheet and easily provide a high-quality image.

According to the present invention, the above object can be attained by a thermal transfer image-receiving sheet comprising a substrate sheet and an intermediate layer and a receptive layer provided in that order on at least one side of the substrate sheet, the intermediate layer being formed of at least one resin having an active hydrogen, the receptive layer comprising at least one thermoplastic resin and a curing agent reactive with the active hydrogen.

In the thermal transfer image-receiving sheet having the above constitution, the active hydrogen in the resin constituting the intermediate layer reacts with the curing agent, enabling the intermediate layer and the receptive layer to be satisfactorily bonded to each other to prevent seperation of the receptive layer from the intermediate layer in the course of thermal transfer. Further, the use of a water-soluble resin, having an active hydrogen, as the resin for constituting the intermediate layer is advantageous in that the amount of the residual solvent can be reduced, the as-coated intermediate layer and receptive layer can be easily dried, leading to improved productivity.

Further, when a thermoplastic resin having an active hydrogen is used as the thermoplastic resin for constituting the receptive layer, the active hydrogen reacts with the curing agent contained in the receptive layer, resulting in improved heat resistance of the receptive layer and solution to the problem of fusing between the receptive layer and the ink layer in the course of thermal transfer, i.e., improved releasability of the receptive layer.

DETAILED DESCRIPTION OF THE INVENTION

Preferred embodiments of the present invention will now be described in detail.

Substrate Sheet

The substrate sheet functions to support a receptive layer and, preferably, is not deformed by heat applied at the time of thermal transfer and has mechanical strength high enough to cause no trouble when handled in a printer or the like.

Materials for constituting the substrate sheet are not particularly limited, and examples thereof include various types of papers, such as capacitor paper, glassine paper, parchment paper, papers having high size fastness, wood free paper, art paper, coat paper, cast coated paper, wall paper, backing paper, paper impregnated with a synthetic resin or an emulsion, paper impregnated with a synthetic rubber latex, paper with a synthetic resin internally added thereto, cellulose fiber paper, such as paperboard, synthetic papers, such as polyolefin and polystyrene papers, and films or sheets of various plastics, for example, polyesters, polymethacrylates, polycarbonates, polyurethane, polyimides, polyetherimides, cellulose derivatives, polyethylene, ethylene/vinyl acetate copolymer, polypropylene, polystyrene, polyacrylonitrile, polyvinyl chloride, polyvinylidene chloride, polyvinyl alcohol, polyvinyl butyral, nylon, polyetheretherketone, polysulfone, polyethersulfone, tetrafluoroethylene/perfluoroalkyl vinyl ether copolymer, polyvinyl fluoride, tetrafluoroethylene/ethylene copolymer, tetrafluoroethylene/hexafluoropropylene copolymer, polychlorotrifluoroethylene, and polyvinylidene fluoride. It is also possible to use a white opaque film, prepared by adding a white pigment or a filler to the above synthetic resin and forming the mixture into a sheet, and a foamed sheet.

Furthermore, laminates of any combination of the above substrate sheets may also be used. Representative examples of the laminate include a laminate of cellulose fiber paper and synthetic paper and a laminate of cellulose fiber paper and a synthetic paper of a plastic film or sheet.

The thickness of the substrate sheet may be any suitable one and usually in the range of from about 10 to 300 μm. If the substrate sheet has poor adhesion to a layer provided thereon, the surface of the substrate sheet may be subjected to various types of primer treatment or corona discharge treatment.

Intermediate Layer

Preferably, the intermediate layer formed on the substrate sheet is adhered firmly to the receptive layer to prevent seperation of the receptive layer from the intermediate layer at the time of thermal transfer and preferably comprises at least one resin having an active hydrogen.

Examples of such a resin include cellulosic resins, such as various cellulose esters and cellulose ethers; polyvinyl alcohol, vinyl resins, such as ethylene/vinyl acetate copolymer, polyvinyl acetate, vinyl chloride/vinyl acetate copolymer, and vinyl acetate/(meth)acrylate copolymer; polyvinyl acetal resins, such as polyvinyl formal, polyvinyl acetoacetal, and polyvinyl butyral; and other resins, such as phenoxy resins, polyamides, polyesters, polycarbonates, polyurethanes, melamine resins, urea resins, and benzoguanamine resins.

The resin for constituting the intermediate layer is not limited to these resins only, and various resins having an active hydrogen on its side chain and/or its terminal can be widely used.

To facilitate the removal of the solvent in the as coated receptive layer is an important function of the intermediate layer. In this respect, the intermediate layer per se is formed of a resin having an active hydrogen and, at the same time, preferably soluble in water. For this reason, the intermediate layer per se is composed mainly of a water-soluble resin having an active hydrogen, and the intermediate layer is formed by preparing a coating liquid from this resin using a solvent composed mainly of water. In this case, solvents other than water include alcohols, such as methanol, ethanol, and isopropyl alcohol, and cellosolves, such as methyl cellosolve and ethyl cellosolve.

In the present invention, the water-soluble resin refers to a resin which, when added to a solvent composed mainly of water, forms a solution (polymer particle diameter: not more than 0.01 μm), a colloidal dispersion (polymer particle diameter: more than 0.01 μm to not more than 0.1 μm), an emulsion (polymer particle diameter: more than 0.1 μm to not more than 1 μm), or a slurry (polymer particle diameter: more than 1 μm). Specifically, the water-soluble resin usable in the present invention may be not only a resin soluble in water but also a resin from which a coating liquid in the form of an emulsion, a dispersion or the like can be prepared using water or the like as a medium.

The water-soluble resin is preferably sparingly soluble or insoluble in a general-purpose organic solvent. The term "insoluble" used herein means that the solubility is not more than 1%.

Examples of the organic solvent include alcohols such as hexane, cyclohexane, acetone, methyl ethyl ketone, xylene, ethyl acetate, butyl acetate, toluene, methanol, ethanol, and isopropyl alcohol.

Water-soluble resins include cellulosic resins (particularly cellulose ethers, methyl cellulose, ethyl cellulose, benzyl cellulose, trityl cellulose, cyanoethyl cellulose, carboxymethyl cellulose, carboxyethyl cellulose, aminoethyl cellulose, oxyethyl cellulose, hydroxyethylmethyl cellulose, and hydroxypropylmethyl cellulose), polysaccharide resins, such as starch, proteins (casein being particularly preferred), gelatin, agar-agar, vinyl resins, such as polyvinyl alcohol, ethylene/vinyl acetate copolymer, polyvinyl acetate, vinyl chloride/vinyl acetate copolymer, vinyl acetate/(meth) acrylate copolymer, vinyl acetate/Veova copolymer, (meth) acrylate resin, styrene/(meth)acrylate copolymer, and styrene resin, melamine resin, urea resin, benzoguanamine resin, polyamides, polyesters, and polyurethanes.

Among these water-soluble resins, a resin which is neither soluble nor swells in the above general-purpose solvent is particularly preferred. In this respect, a resin soluble in a solvent composed mainly of water is most preferred. Specifically preferred is a polyvinyl alcohol (hereinafter referred to as "PVA") with a polyvinyl alcohol having a degree of saponification of not less than 70 to less than 100% by mole being still preferred, and the degree of polymerization of the water-soluble resin is not particularly limited.

If necessary, a fluorescent brightening agent may be added to the intermediate layer in order to enhance the whiteness of the image-receiving face of the thermal transfer image-receiving sheet.

The fluorescent brightening agent may be any known compound having a fluorescent brightening effect, such as stilbene, distilbene, benzoxazole, styryl-oxazole, pyrene-oxazole, coumarin, aminocoumarin, imidazole, benzimidazole, pyrazoline, distyryl-biphenyl, and thiazole fluorescent brightening agents.

The fluorescent brightening agent may be added by any method. Specific examples of the method include one wherein the fluorescent brightening agent is dissolved in an organic solvent according to the dissolution property of the binder resin and then added, one wherein the fluorescent brightening agent is dissolved in water and then added, one wherein the fluorescent brightening agent is pulverized and dispersed in a ball mill or a colloid mill and then added, one wherein the fluorescent brightening agent is dissolved in a high-boiling solvent, mixed with a hydrophilic colloidal solution, and added as an oil-in-water type dispersion, and a method wherein the fluorescent brightening agent is impregnated into a polymer latex and then added.

A preferred fluorescent brightening agent is a water-soluble florescent brightening agent. When a water-soluble fluorescent brightening agent is used, the resin constituting the intermediate layer too is preferably soluble in water from the viewpoint of the miscibility. In such a combination, since the receptive layer is not soluble in water, it is difficult for the water-soluble fluorescent brightening agent to migrate into the receptive layer, making it possible to prevent the deterioration of various fastness properties, particularly light fastness. Among these fluorescent brightening agents, those having a hydrophilic group, such as a sulfonic group, are particularly preferred because they are more difficult to migrate into the receptive layer. Stilbene fluorescent brightening agents represented by the following chemical formula 1 are most preferred because they possess a color tone having a fluorescence peak at 400 to 500 nm and are less likely to cause a reduction in intensity of fluorescence due to association and coagulation.

When these stilbene fluorescent brightening agents are used, a water-soluble resin used in combination therewith should have a hydroxyl group because, if the polymer used has no hydroxyl group, contemplated fluorescent brightening effect cannot be attained.

The intermediate layer functions to improve the whiteness of the image-receiving face of the thermal transfer image-receiving sheet, offering a high contrast between an image area and a non-image area and a good appearance. The whiteness of the thermal transfer image-receiving sheet can be regulated as desired by the kind and amount of the fluorescent brightening agent and a separately added white pigment or the like.

The intermediate layer is provided on a substrate sheet, and a receptive layer is provided thereon. When the adhesion between the substrate sheet and the intermediate layer or the adhesion between the intermediate layer and the receptive layer is low, the adhesion of the intermediate layer to the substrate sheet or the receptive layer can be improved by further adding a water-soluble resin, having adhesion to the substrate sheet or receptive layer, to the intermediate layer.

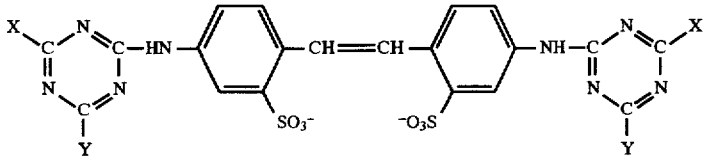

(1)

In the chemical formula 1, X and Y may represent a hydrogen atom or an alkyl, substituted alkyl, hydroxy, alkoxy, substituted alkoxy, amino, or substituted amino group. However, substituents represented by the following group of chemical formulae 2 are preferred as X and Y from the viewpoints of various properties such as brightening effect, solubility, and light fastness. X:

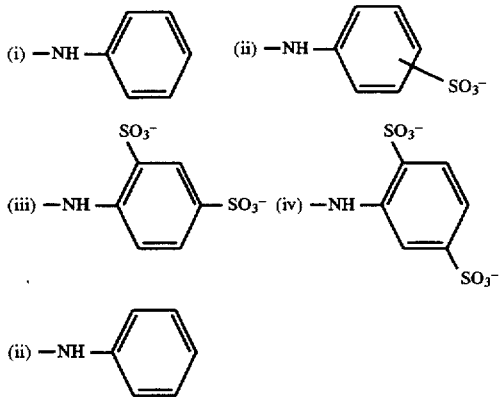

(i) $-NH_2$ (iii) $-OCH_3$ (iv) $-NHCH_3$ (v) $-NHC_2H_5$ (vi) $-OH$ (vii) $-NHCH_2CH_2OH$ (viii) $-N(CH_2CH_2OH)_2$ (ix) $-N(C_2H_5)_2$ (x) $-N(CH_3)(CH_2CH_2OH)$ (xi) $-OCH_2CH_2OH$ (xii) $-NHCH_2CH_2OCH_3$ (xiii) $-N[CH_2CH(OH)CH_3]_2$ Among the above substituents, preferred combinations of X and Y are as follows:

(1) X:(ii) Y:(viii)

(2) X:(iv) Y:(ix)

The water-soluble resin for improving the adhesion preferably has adhesion both to the substrate and the receptive layer, and water-soluble resins usable for this purpose include vinyl resins containing a vinyl alcohol or (meth) acrylic acid component, for example, ethylene/vinyl acetate copolymer, polyvinyl acetate, vinyl chloride/vinyl acetate copolymer, vinyl acetate/(meth)acrylate copolymer, vinyl acetate/Veova copolymer, (meth)acrylate resin, styrene/(meth)acrylate copolymer, and styrene resin. It is also possible to blend an emulsion adhesive such as melamine resin, urea resin, benzoguanamine resin, or polyamide resin. Further, aqueous compositions of thermoplastic resins may also be used, and resins of the same type as used in the receptive layer, such as polyester resin, polyurethane resin, and vinyl chloride resin, are also preferred.

The water-soluble resin for improving the adhesion may be any one which, when added to a solvent composed mainly of water, forms a solution (polymer particle diameter: not more than 0.01 μm), a colloidal dispersion (polymer particle diameter: more than 0.01 μm to not more than 0.1 μm), an emulsion (polymer particle diameter: more than 0.1 μm to not more than 1 μm), or a slurry (polymer particle diameter: more than 1 μm). It can be used as an optimal aqueous coating liquid.

Further, solvents, such as alcohols and cellosolves, may be added to a coating liquid for the intermediate layer in such an amount as will be miscible with the coating liquid from the viewpoint of stabilizing the solution, preventing foaming, or attaining azeotropic effect.

According to the present invention, titanium oxide can be added to the intermediate layer for the purpose of hiding glaring and irregularities of the substrate. The addition of the titanium oxide can increase the degree of freedom of the selection of the substrate. The titanium oxide can be classified into two types, rutile titanium oxide and anatase titanium oxide. When the whiteness and the effect of the fluorescent brightening agent are taken into consideration, preference is given to anatase titanium oxide, which exhibits UV absorption on a shorter wavelength side, over rutile titanium oxide. When it is difficult to disperse the titanium oxide in the aqueous polymer solution, titanium oxide having a surface subjected to a treatment for rendering the surface hydrophilic may be used, or alternatively titanium oxide may be successfully dispersed by adding a known dispersant such as a surfactant or ethylene glycol.

The amount of the titanium oxide added is preferably 10 to 300 parts by weight on a solid basis per 100 parts by weight on a solid basis of the water-soluble polymer.

Receptive Layer

The receptive layer provided on the intermediate layer functions to receive a dye being transferred from a thermal transfer sheet upon heating and to hold the resultant image thereon.

The receptive layer of the present invention comprises at least one thermoplastic resin and a curing agent reactive with an active hydrogen.

Resins usable for forming the receptive layer include halogenated resins such as polyvinyl chloride and polyvinylidene chloride; vinyl resins such as polyvinyl acetate, ethylene/vinyl acetate copolymer, vinyl chloride/vinyl acetate copolymer, polyacrylic esters, polystyrene resin, polyvinyl formal, polyvinyl butyral, and polyvinyl acetal; saturated and unsaturated various polyester resins; polyamide resins; polycarbonate resins; cellulosic resins such as cellulose acetate; urea resin; melamine resin; and benzoguanamine resin. These resins may be used singly or as a blend of two or more so far as they are miscible with each other or one another.

The conventional isocyanate compounds, organometal compounds, and amino compounds are preferred as the curing agent reactive with the active hydrogen. In order to enhance the curing reaction rate, the curing agent may be used in combination with a suitable catalyst. Although the amount of the curing agent added may vary depending upon the kind of the curing agent used, it is preferably such that the receptive layer can be adhered to the intermediate layer.

The above curing agent can react with the active hydrogen in the resin of the intermediate layer to improve the adhesion between the intermediate layer and the receptive layer.

As a result, the receptive layer and the intermediate layer are strongly adhered to each other even when a water-soluble resin is used as the resin for constituting the intermediate layer, enabling the receptive layer, in the thermal transfer, to come into close contact with the ink layer of the thermal transfer sheet and to be smoothly separated from the thermal transfer sheet.

When the thermoplastic resin has an active hydrogen, the curing agent reacts with both the resin constituting the receptive layer and the resin constituting the intermediate layer, resulting in further improved adhesion of the receptive layer to the intermediate layer. Further, in this case, the resultant receptive layer advantageously has excellent releasability from the ink layer.

The above resin constituting a receptive layer, when heat is applied upon thermal transfer of a dye, can fuse to a binder resin used for holding sublimable dyes in an ink layer of a thermal transfer sheet. In order to prevent this and provide better releasability, it is preferred to incorporate in the receptive layer various release agents, such as phosphoric esters, surfactants, fluorine compounds, fluororesins, silicone compounds, silicone oil, or silicone resin. The addition of a modified silicone oil followed by a reaction with the curing agent is particularly preferred.

The amount of the release agent added varies depending upon the kind of the release agent. In general, however, the amount of the release agent is about 1 to 20 parts by weight based on 100 parts by weight of the resin on a solid basis and is preferably such that good releasability is provided in the thermal transfer.

When a modified silicone oil having a group reactive with the above curing agent, such as a hydroxyl-modified silicone and a carboxyl-modified silicone, among modified silicone oils is added, the equivalent ratio of the modified silicone oil to the reactive group of the curing agent is preferably in the range of from 1:1 to 1:10. Alternatively, it is also possible to laminate, as a release layer, a layer of the release agent alone or a layer of a mixture of a binder resin with the release agent on the receptive layer.

A pigment or a filler, such as titanium oxide, zinc oxide, or finely divided silica, may be added to the receptive layer for the purpose of enhancing the whiteness or providing matte appearance.

The receptive layer may be formed by dissolving or dispersing a mixture of the resin with the optional additive (s) in a suitable organic solvent, coating the coating solution (dispersion) onto the whiteness-improving layer by, for example, gravure printing, screen printing or reverse roll coating using a gravure plate, and drying the resultant coating.

Although the thickness of the receptive layer thus formed may be any desired value, it is generally in the range of from 1 to 50 μm.

Back Side Layer

A back side layer may be provided on the back side of the thermal transfer image-receiving sheet for purposes of improvement in mechanical carriability of the sheet, prevention of curling of the sheet, or attainment of antistatic effect or for other purposes. When improved carriability of the sheet is desired, it is preferred to add a suitable amount of an organic or inorganic filler to a binder resin or alternatively to use a highly slippery resin such as a polyolefin resin or a cellulose resin.

On the other hand, when it is desired to impart an antistatic property to the sheet, a conductive resin filler, such as an acrylic resin, and various antistatic agents, such as a fatty acid ester, a sulfuric ester, a phosphoric ester, an amide, a quaternary ammonium salt, a betaine, an amino acid, or an ethylene oxide adduct, may be added to the back side layer, or alternatively, an antistatic layer containing an antistatic agent may be provided between the back side layer and the substrate.

The amount of the antistatic agent may vary depending upon the location of the layer, to which the antistatic layer is added, and the type of the antistatic agent. In all cases, however, the surface resistivity of the thermal transfer image-receiving sheet should preferably be not more than $10^{14}$ Ω/□. When the surface resistivity exceeds $10^{14}$ Ω/□, thermal transfer image-receiving sheets are likely to adhere to each other due to static electricity, causing sheet-feed troubles in a printer. The amount of the antistatic agent used is preferably in the range of from 0.01 to 3.0 g/m$^2$. When the amount of the antistatic agent used is not more than 0.01 g/m$^2$, the antistatic effect is unsatisfactory. On the other hand, the use of the antistatic agent in an amount of not less than 3.0 g/m$^2$ is less cost-effective and, at the same time, unfavorably poses problems of tackiness and the like.

The thermal transfer image-receiving sheet of the present invention can be effectively used as an image-receiving sheet of a dye sublimation thermal transfer sheet. In addition, it can be used also as a hot-melt thermal transfer sheet, comprising a hot melt ink layer of a colorant, such as a pigment, held by a hot-melt binder, wherein upon heating the ink layer, in its entirety, is transferred to an object.

In the thermal transfer, thermal energy may be applied by any conventional means. For example, a contemplated purpose can be sufficiently attained by applying a thermal energy of about 5 to 100 mJ/mm$^2$ through the control of a recording time by means of a recording device, such as a thermal printer (for example, a video printer VY-100 manufactured by Hitachi, Limited).

The following examples further illustrate the present invention but are not intended to limit it. In the following examples, all "%" or "parts" are by weight unless otherwise specified.

Compositions of coating liquids for an intermediate layer and compositions of coating liquids for a receptive layer used in the following examples and comparative examples and a composition of a coating liquid, for a release layer used in some of the following examples are summarized below.

Coating liquid for intermediate layer

| | |
|---|---|
| 1) Cellulose resin (Cellogen F-7A, manufactured by Dai-Ichi Kogyo Seiyaku Co., Ltd.) | 10 parts |
| Water | 90 parts |
| 2) PVA (Gosenol NM-11, manufactured by Nippon Synthetic Chemical Industry Co., Ltd.) | 10 parts |
| Water/ethanol (weight ratio = 9/1) | 90 parts |
| 3) PVA (Gosenol NM-11, manufactured by Nippon Synthetic Chemical Industry Co., Ltd.) | 10 parts |
| Fluorescent brightening agent (Leucopure EGM, manufactured by Sandoz) | 4 parts |
| Water/ethanol (weight ratio = 9/1) | 90 parts |
| 4) PVA (Gosenol C-500, manufactured by Nippon Synthetic Chemical Industry Co., Ltd.) | 10 parts |
| Fluorescent brightening agent (TINOPAL PT, manufactured by Ciba-Geigy Co.) | 4 parts |
| Titanium oxide (TCA888 anatase type, manufactured by Tochem Products Corporation) | 30 parts |
| Water/isopropyl alcohol (weight ratio = 9/1) | 90 parts |
| 5) PVA (Gosenol KL-05, manufactured by Nippon Synthetic Chemical Industry Co., Ltd.) | 10 parts |
| Polyester resin (Vylonal MD-1200, manufactured by Toyobo Co., Ltd) | 30 parts |
| Fluorescent brightening agent (TINOPAL SFP, manufactured by Ciba-Geigy Co.) | 2 parts |
| Water/methyl cellosolve (weight ratio = 8/2) | 90 parts |
| 6) PVA (Gosenol KL-05, manufactured by Nippon Synthetic Chemical Industry Co., Ltd.) | 10 parts |
| Urethane resin (Elastron C-9, manufactured by Dai-Ichi Kohgyo Seiyaku Co., Ltd.) | 50 parts |
| Fluorescent brightening agent (TINOPAL SFP, manufactured by Ciba-Geigy Co.) | 6 parts |
| Titanium oxide (ASD anatase type, manufactured by Tochem Products Corporation) | 40 parts |
| Water/ethyl cellosolve (weight ratio = 8/2) | 90 parts |
| 7) PVA (Gosenol KL-05, manufactured by Nippon Synthetic Chemical Industry Co., Ltd.) | 10 parts |
| Polyvinyl chloride (B-300, manufactured by Denki Kagaku Kogyo k.k.) | 50 parts |
| Fluorescent brightening agent (TINOPAL SFP, manufactured by CIBA-GEIGY CO.) | 2 parts |
| Water/butyl cellosolve (weight ratio = B/2) | 90 parts |
| 8) PVA (Gosenol KL-05, manufactured by Nippon Synthetic Chemical Industry Co., Ltd.) | 10 parts |
| Polyvinyl acetate (Polysol AX-428, manufactured by Showa High Polymer Co., Ltd.) | 20 parts |
| Fluorescent brightening agent (TINOPAL SFP, manufactured by Ciba-Geigy Co.) | 4 parts |
| Titanium oxide (A-150 anatase type, manufactured by Sakai Chemical Co. Ltd.) | 20 parts |
| Water | 90 parts |
| 9) PVA (Gosenol KL-05, manufactured by Nippon Synthetic Chemical Industry Co., Ltd.) | 10 parts |
| Polystyrene (Polysol C-10, manufactured by Showa High Polymer Co., Ltd.) | 20 parts |
| Fluorescent brightening agent (TINOPAL SFP, manufactured by Ciba-Geigy Co.) | 2 parts |
| Water | 90 parts |
| 10) PVA (Gosenol KL-05, manufactured by Nippon Synthetic Chemical Industry Co., Ltd.) | 10 parts |
| Styrene/acrylate resin (Polysol AT-2011, manufactured by Showa High Polymer Co., Ltd.) | 20 parts |
| Fluorescent brightening agent (TINOPAL SFP, manufactured by Ciba-Geigy Co.) | 2 parts |
| Titanium oxide (CR-60 anatase type, manufactured by Ishihara Sangyo Kaisha Ltd.) | 2 parts |
| Water | 90 parts |
| 11) Cellulose acetate (L-30, manufactured by Daicel Chemical Industries, Ltd.) | 10 parts |
| Fluorescent brightening agent (Uvitex OB, manufactured by Ciba-Geigy Co.) | 1 part |
| Titanium oxide (TCA-888 anatase type, manufactured by Ishihara Sangyo Kaisha Ltd.) | 30 parts |
| Methyl ethyl ketone (Methyl ethyl ketone will be hereinafter referred to as "MEK.") | 90 parts |

Coating liquids for receptive layer

| | |
|---|---|
| 1) Vinyl chloride/vinyl acetate copolymer resin (#1000C, manufactured by Denki Kagaku Kogyo k.k.) | 10 parts |
| Isocyanate compound (Sumidur, manufactured by Sumitomo Bayer Urethane Co., Ltd.) | 3 parts |
| Dibutyl tin dilaurate | 0.02 part |
| Addition polymerization type silicone (KNS 202A, manufactured by The Shin-Etsu Chemical Co., Ltd.) | 1 part |
| Catalyst (CAT-PL-8, manufactured by The Shin-Etsu Chemical Co., Ltd.) | 0.6 part |
| MEK/toluene (weight ratio = 1/1) | 40 parts |
| 2) Polyester (Vylon 200, manufactured by Toyobo Co., Ltd.) | 10 parts |
| Hydroxyl-modified silicone (X-22-160AS, manufactured by The Shin-Etsu Chemical Co., Ltd.) | 0.3 part |
| Isocyanate compounds (Takenate A-14, manufactured by Takeda Chemical Industries) | 2 parts |
| Dibutyl tin dilaurate | 0.02 part |
| MEK/toluene (weight ratio = 1/1) | 40 parts |
| 3) Vinyl chloride/vinyl acetate copolymer resin (#1000C, manufactured by Denki Kagaku Kogyo k.k.) | 7 parts |
| Polyester (Vylon 600, manufactured by Toyobo Co., Ltd.) | 3 parts |
| Chelate compounds (Orgatix TC-100, manufactured by Matsumoto Trading Co., Ltd.) | 1 part |
| MEK/toluene (weight ratio = 1/1) | 40 parts |
| 4) Vinyl chloride/vinyl acetate copolymer resin (#1000A, manufactured by Denki Kagaku Kogyo k.k.) | 10 parts |
| Addition polymerization type silicone (KNS202A, manufactured by The Shin-Etsu Chemical Co., Ltd.) | 0.3 part |
| Catalyst (CAT-PL-8, manufactured by The Shin-Etsu Chemical Co., Ltd.) | 0.2 part |
| MEK/toluene (weight ratio = 1/1) | 40 parts |

Coating liquid for release layer

| | |
|---|---|
| 1) Amino-modified silicone (KF-393, manufactured by The Shin-Etsu Chemical Co., Ltd.) | 1 part |
| Epoxy-modified silicone (X-22-343, manufactured by The Shin-Etsu Chemical Co., Ltd.) | 1 part |
| MEK | 98 parts |

EXAMPLE 1

A 150 μm-thick synthetic paper (YUPO FPG #150, manufactured by Oji-Yuka Synthetic Paper Co., Ltd.) was provided as a substrate sheet. The coating liquid 1), for an intermediate layer, having the above composition was coated by wire bar coating on one side of the substrate sheet at a coverage of 2.0 g/m$^2$ (dry basis), and the resultant coating was dried at 130° C. for 2 minutes, thereby forming an intermediate layer. Subsequently, the coating liquid 1), for a receptive layer, having the above composition was coated on the intermediate layer by wire bar coating at a coverage of 4.0 g/m$^2$ (dry basis), and the resultant coating was dried at 130° C. for 30 seconds, thereby preparing a thermal transfer image-receiving sheet.

EXAMPLE 2

A thermal transfer image-receiving sheet was prepared in the same manner as in Example 1, except that the coating liquid 2) for an intermediate layer and the coating liquid 2) for a receptive layer were respectively used instead of the coating liquid 1) for an intermediate layer and the coating liquid 1) for a receptive layer of Example 1.

EXAMPLE 3

The procedure of Example 1 was repeated, except that the coating liquid 3) for an intermediate layer and the coating liquid 3) for a receptive layer were respectively used instead of the coating liquid 1) for an intermediate layer and the coating liquid 1) for a receptive layer of Example 1. Further, the coating liquid 1) (effective component: 2%) for a release layer was coated on the receptive layer by wire bar No. 6, and the resulting coating was dried at 130° C. for one minute, thereby preparing a thermal transfer image-receiving sheet.

Example 4

A thermal transfer image-receiving sheet was prepared in the same manner as in Example 1, except that the coating liquid 4) for an intermediate layer and the coating liquid 2) for a receptive layer were respectively used instead of the coating liquid 1) for an intermediate layer and the coating liquid 1) for a receptive layer of Example 1.

EXAMPLE 5

The procedure of Example 1 was repeated, except that the coating liquid 5) for an intermediate layer and the coating liquid 3) for a receptive layer were respectively used instead of the coating liquid 1) for an intermediate layer and the coating liquid 1) for a receptive layer of Example 1. Further, the coating liquid 1) (effective component: 2%) for a release layer was coated on the receptive layer by wire bar No. 6, and the resulting coating was dried at 130° C. for one minute, thereby preparing a thermal transfer image-receiving sheet.

EXAMPLE 6

A thermal transfer image-receiving sheet was prepared in the same manner as in Example 1, except that the coating liquid 6) for an intermediate layer was used instead of the coating liquid 1) for an intermediate layer of Example 1.

EXAMPLE 7

The procedure of Example 1 was repeated, except that the coating liquid 7) for an intermediate layer and the coating liquid 2) for a receptive layer were respectively used instead of the coating liquid 1) for an intermediate layer and the coating liquid 1) for a receptive layer of Example 1.

EXAMPLE 8

The procedure of Example 1 was repeated, except that the coating liquid 8) for an intermediate layer and the coating liquid 3) for a receptive layer were respectively used instead of the coating liquid 1) for an intermediate layer and the coating liquid 1) for a receptive layer of Example 1. Further, the coating liquid 1) (effective component: 2%) for a release layer was coated on the receptive layer by wire bar No. 6, and the resulting coating was dried at 130° C. for one minute, thereby preparing a thermal transfer image-receiving sheet.

EXAMPLE 9

A thermal transfer image-receiving sheet was prepared in the same manner as in Example 1, except that the coating liquid 9) for an intermediate layer was used instead of the coating liquid 1) for an intermediate layer of Example 1.

EXAMPLE 10

A thermal transfer image-receiving sheet was prepared in the same manner as in Example 1, except that the coating liquid 10) for an intermediate layer and the coating liquid 2) for a receptive layer were respectively used instead of the coating liquid 1) for an intermediate layer and the coating liquid 1) for a receptive layer of Example 1.

EXAMPLE 11

A thermal transfer image-receiving sheet was prepared in the same manner as in Example 1, except that the coating liquid 11) for an intermediate layer was used instead of the coating liquid 1) for an intermediate layer of Example 1.

Comparative Example 1

A thermal transfer image-receiving sheet was prepared in the same manner as in Example 1, except that the coating liquid 4) for a receptive layer was used instead of the coating liquid 1) for a receptive layer of Example 1.

Comparative Example 2

A thermal transfer image-receiving sheet was prepared in the same manner as in Example 1, except that the coating liquid 4) for an intermediate layer and the coating liquid 4) for a receptive layer were respectively used instead of the coating liquid 1) for an intermediate layer and the coating liquid 1) for a receptive layer of Example 1.

Comparative Example 3

A thermal transfer image-receiving sheet was prepared in the same manner as in Example 1, except that the coating liquid 8) for an intermediate layer and the coating liquid 4) for a receptive layer were respectively used instead of the coating liquid 1) for an intermediate layer and the coating liquid 1) for a receptive layer of Example 1.

Comparative Example 4

A thermal transfer image-receiving sheet was prepared in the same manner as in Example 1, except that the coating liquid 11) for an intermediate layer and the coating liquid 4) for a receptive layer were respectively used instead of the coating liquid 1) for an intermediate layer and the coating liquid 1) for a receptive layer of Example 1.

Evaluation and Results

Thermal transfer image-receiving sheet samples of Examples 1 to 11 and Comparative Examples 1 to 4 thus prepared were evaluated for (1) residual solvent content, (2) adhesion, and (3) releasability by the following methods, and the results are given in Table 1 (examples) and Table 2 (comparative examples).

Evaluation Methods (1) Residual solvent content

Measuring equipment:

GAS CHROMATOGRAPH GC-14A (manufactured by Shimadzu Seisakusho Ltd.)

C-R4AX CHROMATOPAC (manufactured by Shimadzu Seisakusho Ltd.)

HEDADSPACE SAMPLER HSS-2B (manufactured by Shimadzu Seisakusho Ltd.)

Column:

BX-10 Glass I.D. Φ3 x 2.1 m (manufactured by Shimadzu Seisakusho Ltd.)

Measuring conditions:

Vial temp. 120° C.

Retention time 15 min

Vaporization chamber temp. 130° C.

Column temp. 90° C.

Detector temp. 130° C.

Evaluation criteria:

A (good): 0–50 mg/m$^2$

B (large): 50–100 mg/m$^2$

C (very large): not less than 100 mg/m$^2$ (2) Adhesion (peel test for receptive layer using pressure-sensitive adhesive tape)

A Scotch mending tape (manufactured by Sumitomo 3M Ltd.) was applied onto and then peeled off from an image-receiving face to evaluate the adhesion of the receptive layer.

Evaluation criteria:

○: The tape peeled completely from the image-receiving face.

X: The receptive layer peeled off.

(3) Releasability (service test for releasability of receptive layer in the course of thermal transfer using printer)

Black solid printing was carried out using a print cartridge of a video print kit VY-SS50 in VY-PL (manufactured by Hitachi, Ltd.), and the releasability of the receptive layer was evaluated based on whether or not abnormal transfer occurred.

Evaluation criteria:

○: No abnormal transfer occurred.

X: Abnormal transfer occurred with the receptive layer being stripped by the thermal transfer sheet.

TABLE 1

| Results of evaluation | | | | | |
|---|---|---|---|---|---|
| Test Sample | Composition of intermediate layer/composition of receptive layer | Amount of residual solvent (mg/m$^2$) | Adhesion | Releasability | Overall evaluation |
| Example 1 | 1)/1) | A (35.7) | ○ | ○ | ○ |
| Example 2 | 2)/2) | A (16.0) | ○ | ○ | ○ |
| Example 3 | 3)/3)* | A (3.2) | ○ | ○ | ○ |
| Example 4 | 4)/2) | A (13.8) | ○ | ○ | ○ |
| Example 5 | 5)/3)* | A (14.2) | ○ | ○ | ○ |

TABLE 1-continued

| Results of evaluation | | | | | |
|---|---|---|---|---|---|
| Test Sample | Composition of intermediate layer/composition of receptive layer | Amount of residual solvent (mg/m$^2$) | Adhesion | Releasability | Overall evaluation |
| Example 6 | 6)/1) | A (20.6) | ○ | ○ | ○ |
| Example 7 | 7)/2) | A (27.2) | ○ | ○ | ○ |
| Example 8 | 8)/3)* | A (18.1) | ○ | ○ | ○ |
| Example 9 | 9)/1) | A (20.7) | ○ | ○ | ○ |
| Example 10 | 10)/2) | A (23.8) | ○ | ○ | ○ |
| Example 11 | 11)/1) | C (116.4) | ○ | ○ | ○ |

Note) *Release layer 1) was additionally provided on the receptive layer.

TABLE 2

| Results of evaluation | | | | | |
|---|---|---|---|---|---|
| Test Sample | Composition of intermediate layer/composition of receptive layer | Amount of residual solvent (mg/m$^2$) | Adhesion | Releasability | Overall evaluation |
| Comparative Example 1 | 1)/4) | A (39.5) | x | x | x |
| Comparative Example 2 | 4)/4) | A (30.6) | x | x | x |
| Comparative Example 3 | 8)/4) | A (15.7) | x | x | x |
| Comparative Example 4 | 11)/4) | C (129.8) | x | x | x |

What is claimed is:

1. A thermal transfer image-receiving sheet, comprising:

a substrate sheet;

an intermediate layer formed on at least one surface of said substrate sheet, and consisting essentially of polyvinyl alcohol having an active hydrogen; and a receptive layer formed on said intermediate layer, and comprising at least one thermoplastic resin and a curing agent reactive with the active hydrogen.

2. The thermal transfer image-receiving sheet according to claim 1, wherein said intermediate layer further comprises a fluorescent brightening agent.

3. The thermal transfer image-receiving sheet according to claim 2, wherein said fluorescent brightening agent is soluble in water.

4. The thermal transfer image-receiving sheet according to claim 1, wherein said intermediate layer further comprises titanium oxide.

5. The thermal transfer image-receiving sheet according to claim 4, wherein said titanium oxide is of anatase type.

6. The thermal transfer image-receiving sheet according to claim 1, wherein the curing agent contained in said receptive layer comprises one of an isocyanate compound and an organometallic compound.

7. The thermal transfer image-receiving sheet according to claim 1, wherein said receptive layer further comprises at least one release agent.

8. The thermal transfer image-receiving sheet according to claim 7, wherein said release agent comprises one of an isocyanate compound and a silicone oil reactive with an organometallic compound.

9. The thermal transfer image-receiving sheet according to claim 1, wherein the thermoplastic resin of said receptive layer has an active hydrogen.

* * * * *